US008615830B2

(12) United States Patent
McQuoid

(10) Patent No.: US 8,615,830 B2
(45) Date of Patent: Dec. 31, 2013

(54) COVERED PILLOW HAVING ENCLOSED POCKET CONTAINING CORRESPONDING ARTICLES

(76) Inventor: Vicky McQuoid, Fresno, CA (US)

( * ) Notice: Subject to any disclaimer, the term of this patent is extended or adjusted under 35 U.S.C. 154(b) by 987 days.

(21) Appl. No.: 12/070,215

(22) Filed: Feb. 14, 2008

(65) Prior Publication Data

US 2008/0216243 A1 Sep. 11, 2008

Related U.S. Application Data

(63) Continuation-in-part of application No. 11/684,334, filed on Mar. 9, 2007, now abandoned.

(51) Int. Cl.
*A47C 9/00* (2006.01)

(52) U.S. Cl.
USPC ..... 5/639; 5/636

(58) Field of Classification Search
USPC ..... 5/630, 636, 639–640; D6/601
See application file for complete search history.

(56) References Cited

U.S. PATENT DOCUMENTS 2,293,530 A * 8/1942 Beehler ..... 190/102
3,148,389 A 9/1964 Lustig
3,863,283 A 2/1975 Mohr
4,768,245 A 9/1988 Dutton
4,889,512 A 12/1989 Burnett et al.
5,575,028 A * 11/1996 Brau et al. ..... 5/639
5,778,468 A 7/1998 Saarela et al.
6,216,297 B1 4/2001 Lemke
6,668,400 B1 12/2003 Nichols et al.
7,089,617 B1 8/2006 Lauro
7,461,421 B1 * 12/2008 Faircloth et al. ..... 5/639

* cited by examiner

*Primary Examiner* — Fredrick Conley
(74) *Attorney, Agent, or Firm* — Richard A. Ryan

(57) ABSTRACT

A pillow system comprises a pillow having a pocket extending inside the pillow that contains one or more articles having a theme which corresponds to the theme of the outer surface of the pillow. The pillow has a top panel and a bottom panel joined at the periphery to define a peripheral edge and cushioning material disposed inside. The outer surface, having a cover theme, substantially covers one or both of the panels. The pocket extends into and is substantially enclosed by the cushioning material. Access to the pocket is through a pocket inlet along a portion of the peripheral edge. A closure mechanism, such as a zipper, at the inlet substantially closes the pocket to enclose the articles inside. The articles have an article theme that corresponds to the cover theme. If desired, the pillow can also have a theme shape that corresponds to the cover and article themes.

19 Claims, 6 Drawing Sheets

COVERED PILLOW HAVING ENCLOSED POCKET CONTAINING CORRESPONDING ARTICLES

CROSS-REFERENCE TO RELATED APPLICATIONS

This patent application is a continuation-in-part of U.S. patent application Ser. No. 11/684,334 filed Mar. 9, 2007, now abandoned.

STATEMENT REGARDING FEDERALLY SPONSORED RESEARCH

Not Applicable.

BACKGROUND OF THE INVENTION

A. Field of the Invention

The field of the present invention relates generally to pillows of the type having outer panels enclosing a cushioning material. More particularly, the present invention relates to such pillows that are configured to receive and enclose one or more items inside the pillow. Even more particularly, the present invention relates to such pillows that are configured in a shape and/or covered with material which is selected so as to represent or convey a particular theme.

B. Background

Most people have one or more pillows that are typically used for supporting the head or another portion of the person's body while he or she is sleeping or resting. Pillows are also commonly used to sit on and/or lean against while sitting on a chair, couch, floor or other surface while reading, talking, visiting on the telephone, watching television or a variety of other activities. The common pillow, utilized in the generally functional manner described above, typically has opposing top and bottom panels that are fixedly joined at their periphery to enclose a cushioning material inside the pillow. The top and bottom panels are generally made out of cotton, polyester, silk, cotton/polyester blends and a variety of other materials. The common sleeping pillow has a plain surface that is covered with a pillowcase, which often has a design on it, that may also be made out of a variety of different materials. As well known to those skilled in the art, a wide variety of different materials are utilized as the cushioning material. Generally, these are selected for the ability to comfortably support the user.

Pillows are also utilized, often solely, as decorative items that are placed on the bed, couch, chair or other piece of furniture, adding flair to the furniture item. Typically, these decorative pillows have a covering surface that is colored and/or incorporates one or more design elements. Pillowcases are less commonly utilized with these types of pillows. A decorative pillow will generally be selected to compliment the furniture and/or room in which the pillow is kept, which may match or contrast with the colors or design of the material utilized on the furniture item or used in the room.

Although generally only thought of as functional or decorative items that are utilized as described above, pillows have also been utilized to store items inside the pillow (as opposed to the pillowcase) or in a pocket on the outside of the pillow. Several of these are the subject of issued patents. For instance, U.S. Pat. No. 4,768,245 to Dutton describes a children's pillow and story book combination that comprises a pillow having an external pocket, secured to the outside of one of the panels, that is sized and configured to receive a book therein. The book has a cover on the front with indicia that indicates the subject of the book, of which a portion thereof extends outside of the pocket, and the pillow has printed material on at least one of its surfaces that identifies with the content of the book so the child can associate the book with the pillow. U.S. Pat. No. 7,089,617 to Lauro describes a pillowcase and pillow/pillowcase combination having a pocket in the pillowcase for receiving and hiding articles, such as a watch, jewelry, photos and the like. U.S. Pat. No. 6,668,400 to Nichols, et al. describes an article of bedding having a hidden pocket assembly that allows the bed occupant discreet access to the items stored therein. The hidden pocket assembly includes a fabric pocket liner positioned within a portion of the interior volume of a doubly inwardly folded wide hem. U.S. Pat. No. 6,216,297 to Lemke describes a travel pillow having an interior storage pocket for carrying pajamas and other overnight articles. The pillow has a pocket inside the inner compartment of the outer casement with padding material surrounding the pocket and a zipper closing the pocket. U.S. Pat. No. 5,778,468 to Saarela, et al. describes a combination pillow and plaything that comprises a pillow having a handle with a pocket formed on the exterior surface of the pillow for receiving a toy item at least partially within the pocket. U.S. Pat. No. 3,863,283 to Mohr describes a pillow having an interior storage compartment, which is closed with a zipper, for storing first-aid equipment. U.S. Pat. No. 3,148,389 to Lustig describes a pillow having closeable interior pocket that is sized and configured for receiving one or more insert members that are utilized to affect the degree of pillow softness.

Although the foregoing generally describe pillows having exterior or interior pockets and the use of such pockets to receive and contain items therein, they do not describe pillows which are particularly suitable for use as a means to store and carry items in a manner that the items correspond to the outer surfaces of the pillow. Such a pillow would be particularly suitable as a way to transmit one or more gifts to another person and as a way of storing sentimental items that can be easily associated with the pillow. What is needed, therefore, is a pillow that is particularly configured for receiving and carrying one or more items within the pillow that are selected so as to correspond to the outer surfaces and/or shape of the pillow. The desired pillow system should include a pillow having one or more outer surfaces with designs or other indicia thereon that are generally indicative of the items stored in the pillow's interior pocket. The preferred pillow would be suitable for use as a pillow and as a unique means to transmit one or more items, which can be in the form of a gift, to another person. Preferably, such a pillow would be adaptable to a wide variety of different shapes, designs and items.

SUMMARY OF THE INVENTION

The pillow of the present invention solves the problems and provides the benefits identified above. That is to say, the present invention discloses a covered pillow having an enclosed pocket in which is provided one or more articles that have a theme which corresponds to the theme on the pillow's outer surface and/or shape. The pillow system of the present invention is particularly suited for a person to present the pillow to another person as a way of giving that person the articles contained within the pillow. The pillow system of the present invention is also particularly useful for storing one or more articles in the pillow that correspond to the designs on the pillow's outer surface and/or the shape of the pillow so the user can easily associate the pillow with the articles. Preferably, the improved pillow of the present invention has an interior pocket that can be closed to keep one or more articles inside the pillow while the pillow is utilized in the common manners of use, namely as a support and/or a decorative item. The pillow of the present invention is adaptable to a wide variety of different shapes, outer surface designs and articles.

In a primary embodiment of the present invention, the pillow system comprises a pillow having a top panel and an opposing bottom panel that are joined at the periphery thereof so as to define a periphery edge all around the pillow. Although various other mechanisms can be utilized, the preferred method of joining the panels, which will be commonly made out of cloth, silk or the like, is by stitching. The pillow has a cushioning material disposed between the top and bottom panels and enclosed by the pillow's periphery edge. The pillow has an outer surface that substantially covers one or both of the top panel and bottom panel. The outer surface of the panel(s) has a cover theme thereon. A pocket is disposed inside the pillow such that it extends into and is substantially enclosed by the cushioning material. The pocket is accessible through a pocket inlet along the peripheral edge, typically on one side of the pillow. A closure mechanism is included along the peripheral edge of the pillow at the pocket inlet to at least substantially close the pocket. In the preferred embodiments, the closure mechanism is a zipper. Alternatively, a variety of other closure mechanisms, such as buttons, snaps, Velcro® and the like can be utilized to close the pocket. The pillow also includes one or more articles that are disposed inside the pocket and enclosed by the closure mechanism. The articles are selected to have an article theme that corresponds to the cover theme. In a preferred embodiment, the pocket is made out of pocket panels that are covered with a pocket theme that corresponds to the cover and article themes. In one embodiment, the shape of the pillow itself is of a theme shape that corresponds to the cover and article themes. The articles can be items such as a books, clothing, stuffed animals, toys, dolls, DVDs, video games or a wide variety of other items. The cover and article themes can correspond directly by being of the same subject matter or they can correspond indirectly by being covered with the same or similar design patterns. A wide variety of shapes, sizes and configurations can be utilized with the pillow of the pillow system.

Accordingly, one of the primary aspects of the present invention is to provide a pillow system that provides the advantages discussed above and overcomes the disadvantages and limitations associated with presently available pillow storage systems and pillows utilized in such systems.

It is also an important aspect of the present invention to provide a pillow system that provides an improved means of presenting articles to a person by receiving and storing articles inside the pillow that correspond to the designs on the outer surface of the pillow and/or the shape of the pillow.

It is also an important aspect of the present invention to provide a pillow that comprises a pair of panels which are joined at their periphery with a pocket inlet along one edge thereof allowing access to a pocket inside the pillow for removably storing one or more articles having a theme which corresponds to the theme on the outer surface of the pillow and/or the shape of the pillow.

It is also an important aspect of the present invention to provide a pillow having a cover theme on one or more of the outer panels that corresponds to the theme of one or more articles stored in a pocket disposed in the pillow with the cushioning material around the pocket.

Other aspects and advantages of the pillow of the present invention will be readily apparent to those skilled in the art in light of the figures and description set forth herein.

The above and other aspects of the present invention are explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of one or more of the preferred embodiments and, as such, represent one or more ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are directed to a pillow made out of conventional materials, including the outer panels and cushioning material, those skilled in the art will readily understand that this is set forth merely for purposes of simplifying the present disclosure and that the present invention is not so limited.

Figure 1:
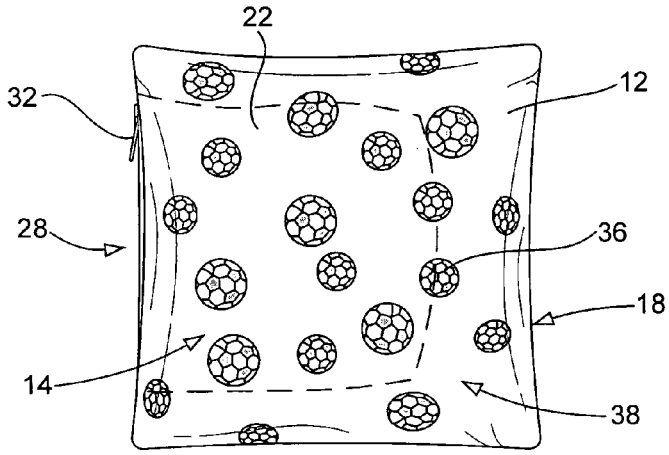
FIG. 1 is a top view of the pillow configured according to a preferred embodiment of the pillow system of the present invention.
Figure 2:
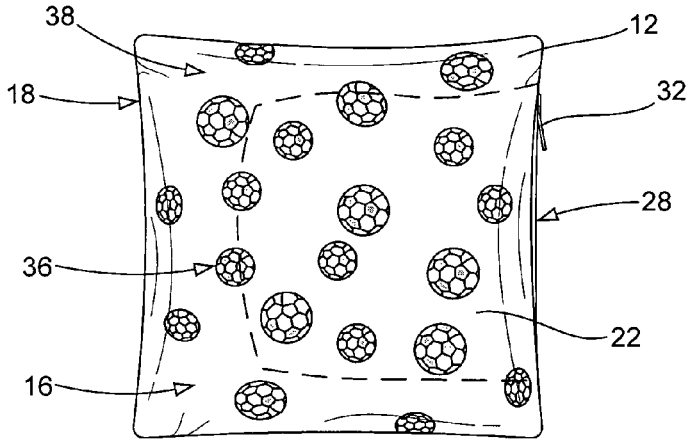
FIG. 2 is a bottom view of the embodiment of the pillow shown in FIG. 1.
Figure 3:
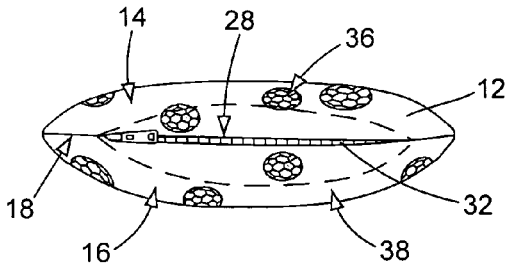
FIG. 3 is a side view of the pillow of FIGS. 1 and 2 shown with the zipper closure mechanism in the closed position.

A pillow system that is manufactured out of the components and configured pursuant to the preferred embodiments of the present invention is shown generally as 10 in FIGS. 5 through 9. The pillow system 10 of the present invention generally comprises a pillow 12 having a top panel 14 and a bottom panel 16 that are joined together at their periphery to define a peripheral edge 18 around pillow 12, as best shown in FIGS. 1 and 2. As with conventional pillows, pillow 12 of the present invention has a cushioning material 20, shown in FIG. 10, that is enclosed between top 14 and bottom 16 panels. As well known in the art, top 14 and bottom 16 panels can be joined utilizing stitching or a variety of other mechanisms that suitably join panels 14/16 fixedly together. Panels 14 and 16 can be made out cotton, polyester, cotton/polyester blends, silk or a wide variety of different materials. Although panels 14 and 16 are conventionally made into a generally square or rectangular shape, as shown in FIGS. 1 through 6 and 8, those skilled in the art know that panels 14 and 16 can be made in a wide variety of different shapes, including the heart shape of FIG. 7 and the round shape of FIG. 9. The cushioning material 20 utilized for pillow 12 is a conventional pillow fill material, such as natural or synthetic fibers, down, foam material and the like, that is selected to make pillow 12 be comfortably padded and, therefore, suitable for use as a headrest when sleeping or resting or as a support when sitting or otherwise.

Figure 4:
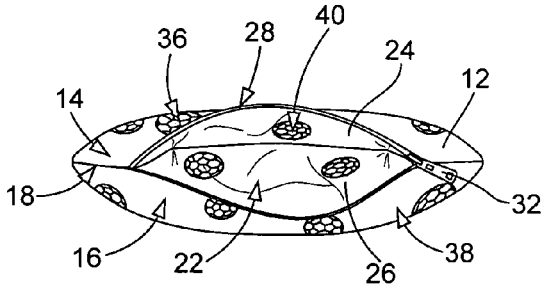
FIG. 4 is a side view of the pillow of FIG. 3 shown with the zipper closure mechanism in the open position to expose the pocket of the pillow.
Figure 5:
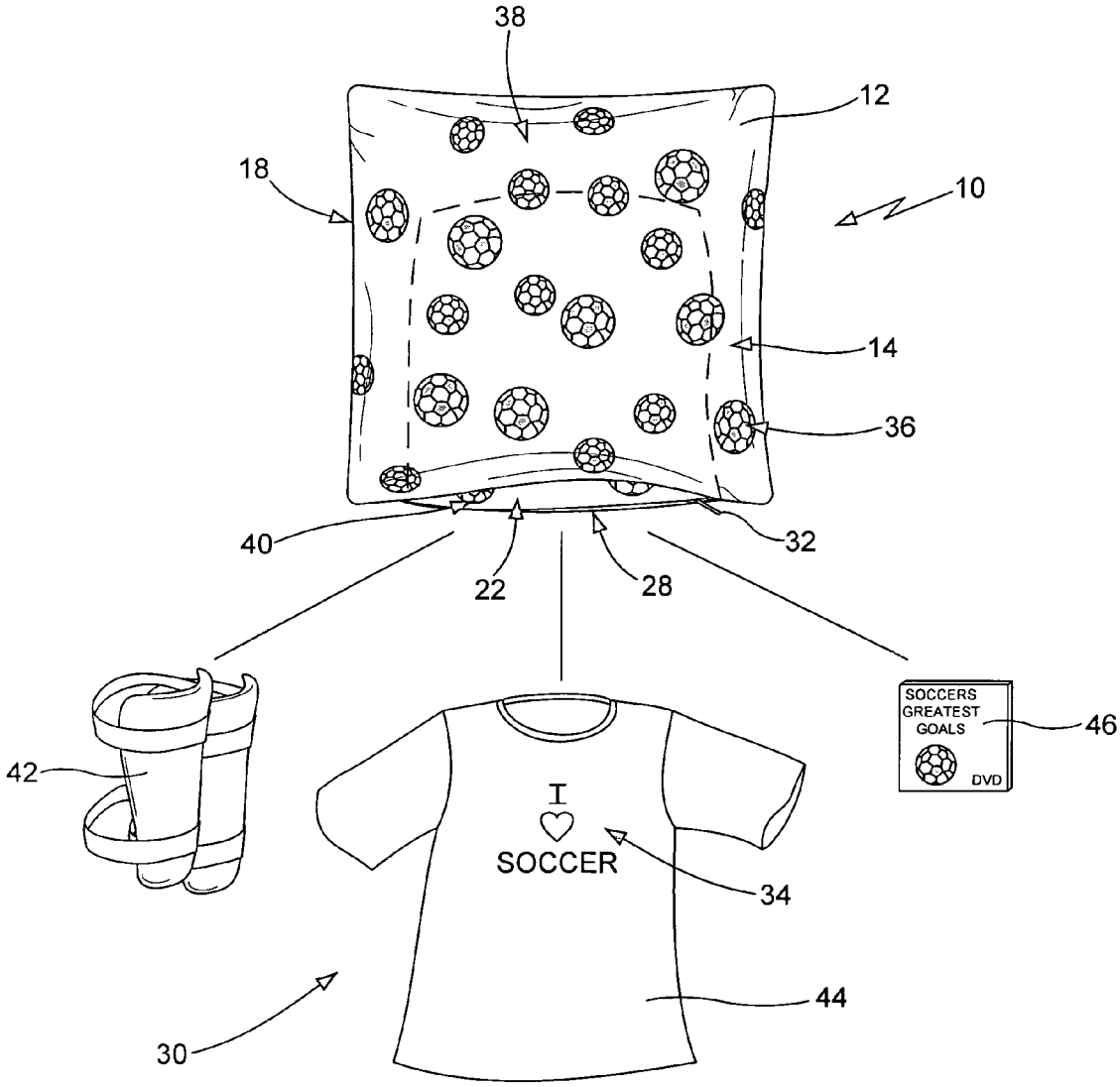
FIG. 5 is a top view of the components of one embodiment of the pillow system of the present invention shown with the pillow of FIGS. 1 through 4.

The top 14 and bottom 16 panels are joined together to form an envelope shaped configuration in which is disposed pocket 22, as best shown in FIG. 4 in the open configuration, inside the envelope. As well known to those skilled in the art, pocket 22 can be made from a pair of pocket panels, such as first pocket panel 24 and second pocket panel 26, that are joined along three sides to form the inside closed portion of pocket 22 which extends into cushioning material 20 such that is it substantially enclosed by cushioning material 20. The fourth side of each of the pocket panels 24 and 26 are joined to one of the top panel 14 or bottom panel 16 so as to attach pocket 22 to pillow 12 and form a pocket inlet 28, best shown in FIG. 4, in the peripheral edge 18 of pillow 12. Typically, the pocket panels 24/26 will be joined together and to the top 14 and bottom 16 panels utilizing stitching. The size of pocket 22 can vary somewhat, from a small sized pocket 22 to one that is only slightly smaller than the size of pillow 12. Preferably, pocket 22 is enough smaller than the dimensions of pillow 12 such that pocket 22 is substantially surrounded on the top and sides, except the side of pocket inlet 28, by cushioning material 20 to provide the desired amount of padding around pocket 22. In use, pocket 22 is accessible through pocket inlet 28 to place one or more articles 30, examples of which are shown in FIGS. 5 through 9, therein. Because pocket 22 is substantially enclosed by the cushioning material 20, the articles 30 inside pocket 22 will be generally protected by the cushioning material 20 and a person utilizing pillow 12 will not be unduly affected by those articles 30, depending on the amount and type of cushioning and the size, shape and hardness of the articles 30.

The preferred embodiment of the pillow system 10 of the present invention has a pillow 12 that includes a closure mechanism 32, such as the zipper shown in the figures, along the peripheral edge 18 at pocket inlet 28 which is configured to at least substantially close pocket 22 so as to retain the articles 30 therein. Various types of metal, plastic and composite zippers 32 are suitable for use with pillow 12 of the present invention. While a zipper is generally the preferred closure mechanism 32, primarily due to its ability to more easily and completely close pocket 22, other closure mechanism 32 can also be utilized with pillow 12 of the present invention. For instance, closure mechanism 32 can comprise snaps, buttons, hook and loop material (i.e., Velcro®), strings or rope thread through a plurality of eyelets or other openings, opposing magnets and a variety of other mechanisms suitable for substantially closing pocket 22.

As stated above, pocket 22 is configured to receive and contain a plurality of articles 30 which, as set forth below, can be a variety of items. The unique feature of the pillow system 10 of the present invention is that the articles 30 have a common article theme 34, shown in FIGS. 5 through 9 and discussed in more detail below, that corresponds to the cover theme 36 on the outer surface 38 substantially covering the top panel 14 and/or bottom panel 16, on pillow 12. In the preferred embodiments, the outer surface 38, having the cover theme 36 thereon, substantially covers both top panel 14 and bottom panel 16. Preferably, a pocket theme 40, corresponding to both article theme 34 and cover theme 36 is also utilized on the surfaces of both the first 24 and second 26 pocket panels that make up pocket 22. A wide variety of different themes are available for the article theme 34, cover theme 36 and pocket theme 40, examples of which are shown in the accompanying figures.

Figure 6:
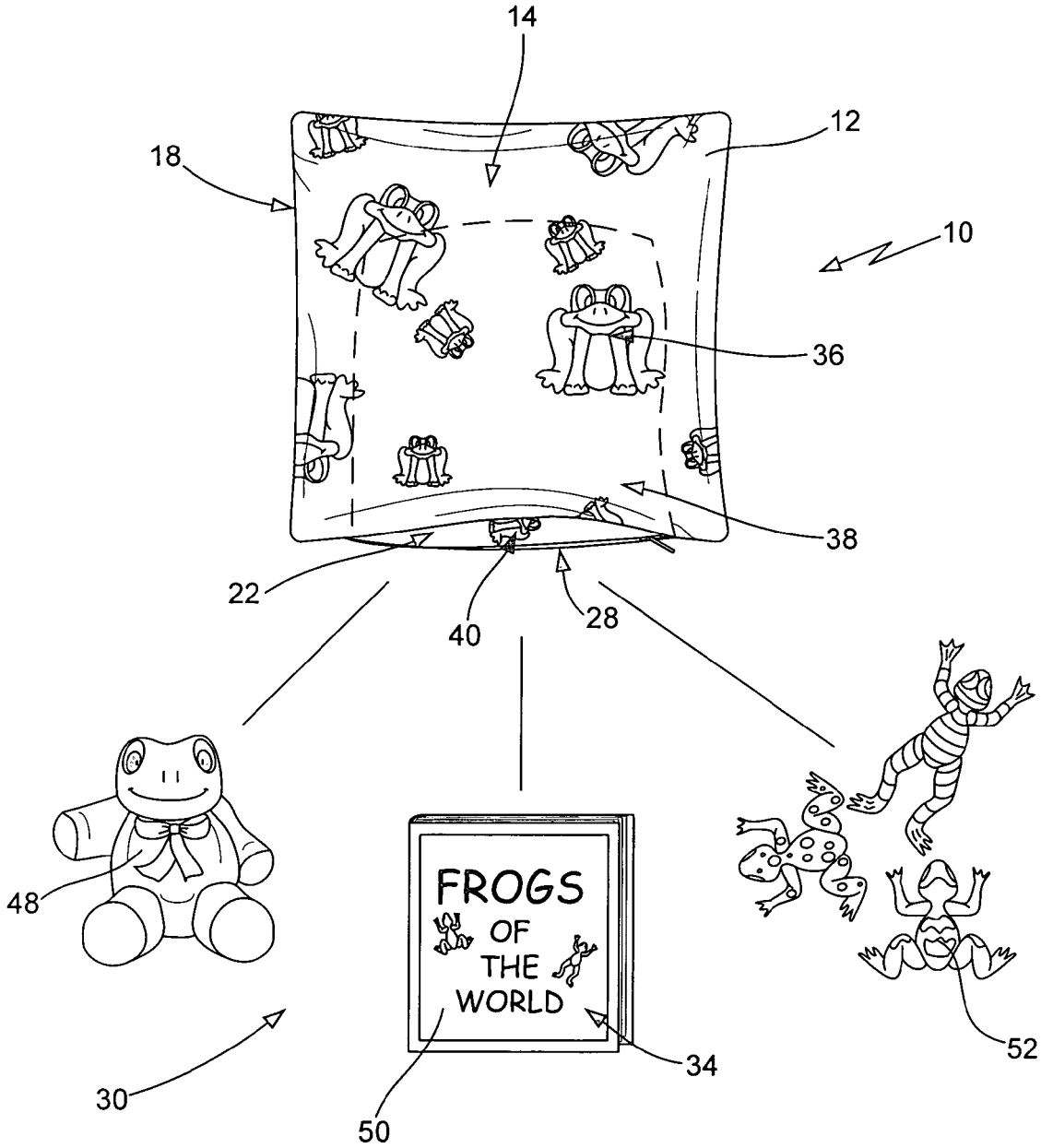
FIG. 6 is a top view of the components of an alternative embodiment of the pillow system of the present invention.
Figure 7:
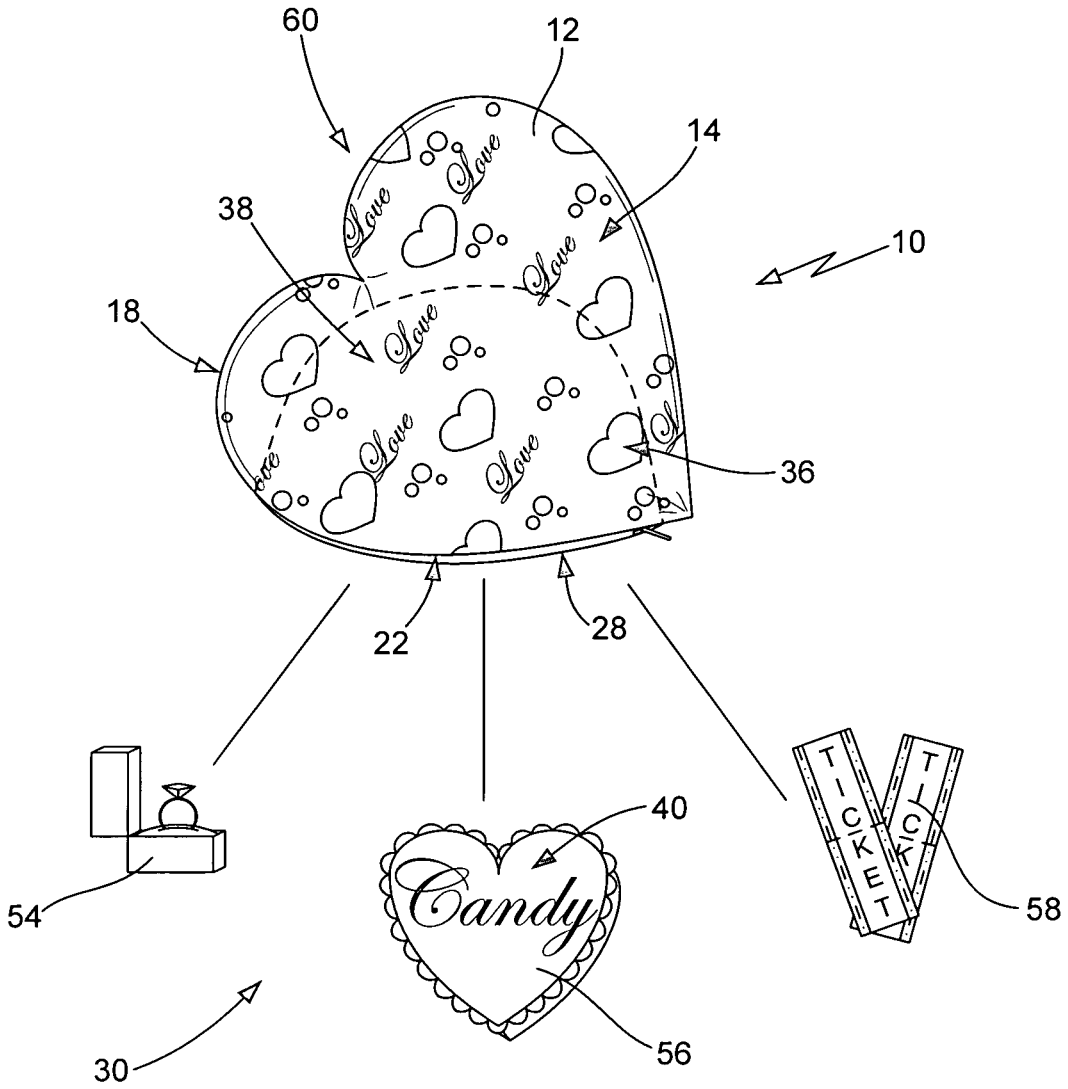
FIG. 7 is a top view of the components of yet another alternative embodiment of the pillow system of the present invention showing use of a pillow having a theme shape corresponding to the theme of the surface and articles.
Figure 8:
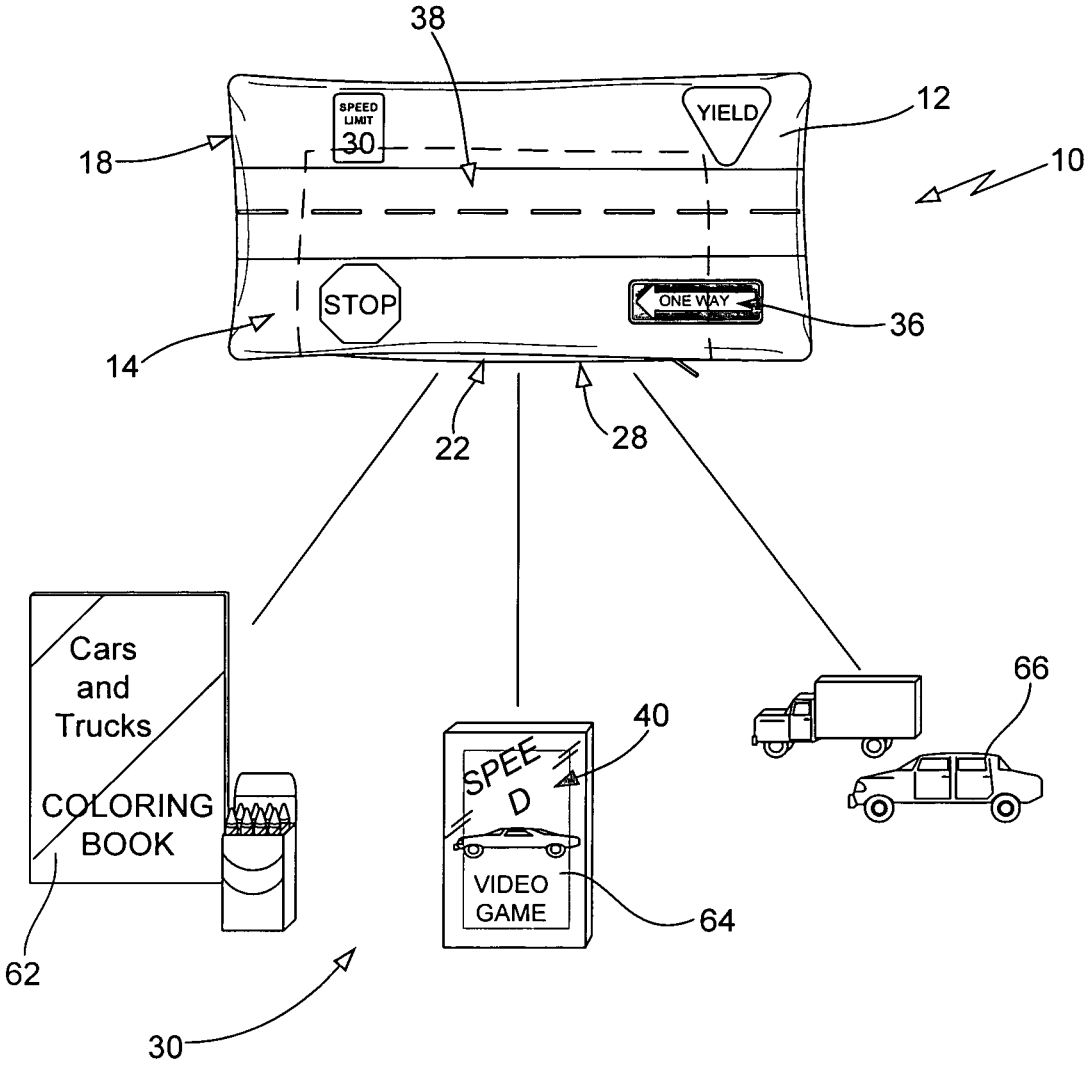
FIG. 8 is a top view of the components of yet another alternative embodiment of the pillow system of the present invention.
Figure 9:
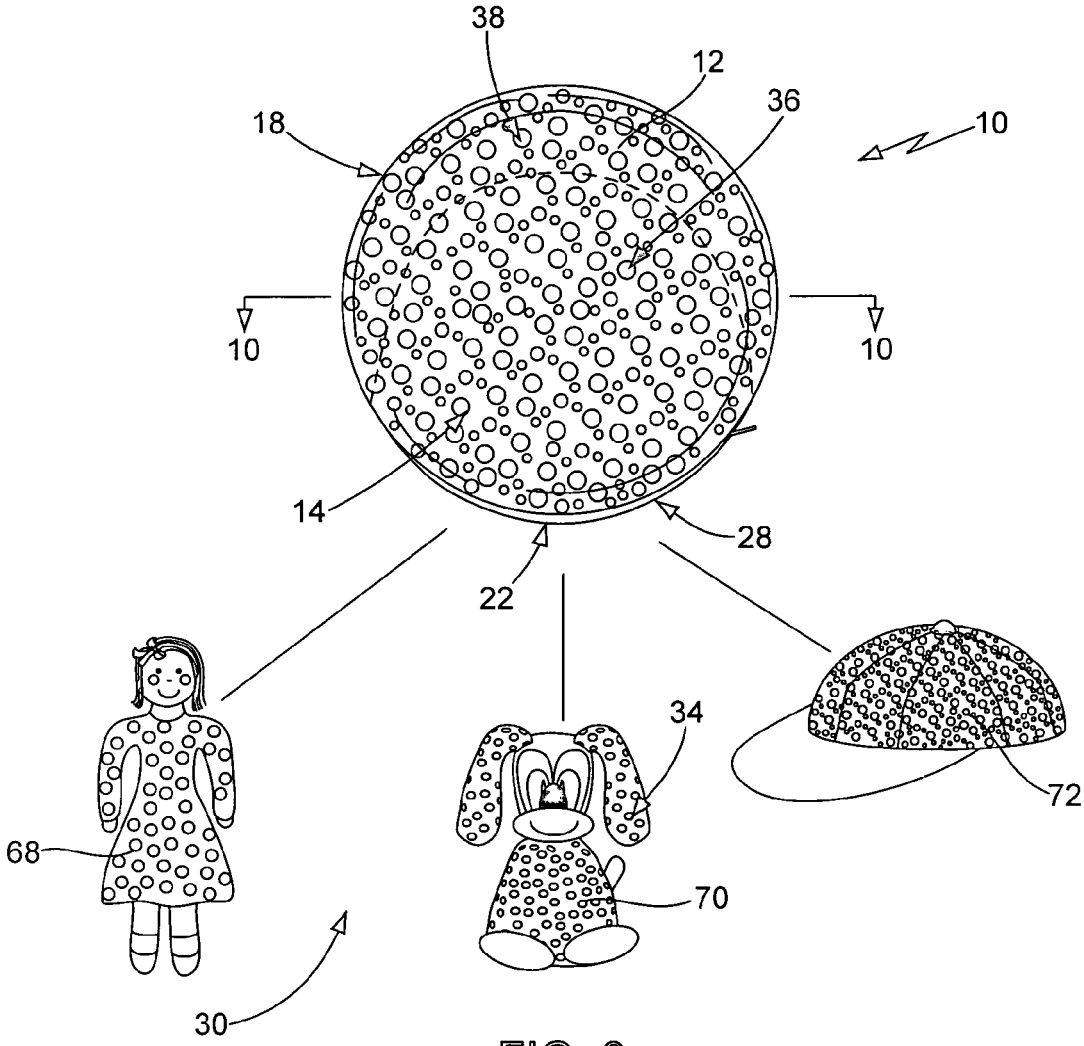
FIG. 9 is a top view of the components of yet another alternative embodiment of the pillow system of the present invention showing a round shaped pillow.
Figure 10:
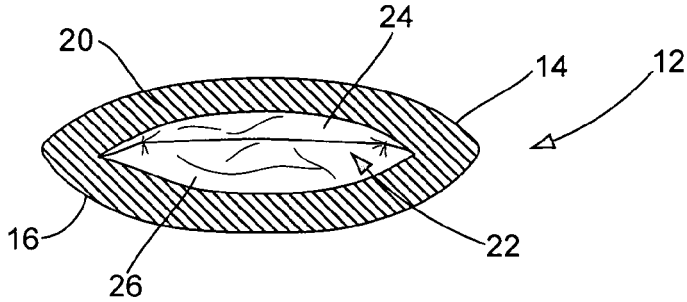
FIG. 10 is a side view of the pillow of FIG. 9 taken through line 10-10 shown on FIG. 9.

In FIGS. 1 through 5, the common theme is soccer, with the cover theme 36 on outer surface 38, covering both the top panel 14 and bottom panel 16, and the pocket theme 40 on pocket panels 24/26 comprising a plurality of soccer balls and the articles 30 being various soccer-related items having article theme 34, such as shin guards 42, a clothing item such as the soccer t-shirt 44 and a DVD 46 having soccer information thereon. In FIG. 6, the common corresponding theme is frogs, with the cover theme 36 on outer surface 38 and pocket theme 40 on pocket panels 24/26 comprising a plurality of frog pictures and the article theme 34 being frog-related articles 30, including a stuffed frog 48, a book on frogs 50 and one or more frog toys 52. In FIG. 7, the common theme is love or relationships, with the cover theme 36 on the outer surface 38 and pocket theme 40 on pocket panels 24/26 comprising a plurality of hearts and love/relationship words (i.e., such as "love") and the article theme 34 being items suitable for showing love or caring towards another, including a ring 54, a box of candy 56 and tickets 58 to a movie, show, game or the like. The pillow system 10 of FIG. 7 also shows the use of theme shape 60 for the shape of pillow 12 itself that corresponds at least to the article theme 34 and cover theme 36. In addition, if desired, pocket theme 40 can also correspond to the same love/relationship theme. In this embodiment, the theme shape 60 is a heart-shaped pillow 12 with closure mechanism 32 on one side of the heart-shaped pillow 12. In FIG. 8, the common theme is motor vehicles, such as cars and trucks, with the cover theme 36 on the outer surface 38 corresponding to the vehicle article theme 34 of articles 30. The cover theme 36 comprises street, road, highway or like related items on the outer surface 38 of top panel 14, which correspond to the article theme 34 of articles 30, including a coloring book 62 (with crayons), a car-related video game 64 and toy cars and trucks 66. The rectangular shape of pillow 12 provides a theme shape 60 that generally corresponds to the vehicle related themes of article theme 34 and cover theme 36. In FIG. 9, the common theme is polka-dots which are utilized as cover theme 36 on outer surface 38 and as the article theme 34 on the surfaces of the various articles 30, which include a doll 68, stuffed animal 70 and a clothing item such as hat 72. The pillow 12 is round-shaped. In this embodiment, the corresponding theme between the article theme 34, cover theme 36 and, if desired, the pocket theme 40 is the design of the materials utilized on articles 30, outer surface 38 and pocket panels 24 and 26. In this example, articles 30 are otherwise unrelated.

The articles 30, article theme 34, cover theme 36, pocket theme 40 and theme shape 60 set forth above are intended only as examples of what can be utilized with pillow system 10 of the present invention and is not intended to limit the scope of the present invention. As will be readily appreciated by those skilled in the art, a wide variety of corresponding themes can be utilized with pillow system 10. The corresponding theme can be presented in a number of different manners, as set forth in the examples above, with the articles 30 directly corresponding to the cover theme 36, as with the soccer or frog theme examples, or corresponding by matching the meaning, as with the love/relationship example, or material, as with the polka-dot example. With regard to the selection of articles 30, the primary consideration is that they fit, as a whole or in pieces or folded, inside pocket 22. It is an advantage, though not a requirement, that the articles 30 either lie generally flat inside pocket 22, be somewhat small sized or be made out of a generally soft or padded material so that the cushioning material 20 will be sufficient to buffer the impact of the articles 30 when the user lays or leans against pillow 12.

In use, the user can purchase pillow system 10 as a unit with the corresponding articles 30 already inside the pocket 22 of pillow 12 such that the article theme 34 matches the cover theme 36 on outer surface 38. Preferably, the pocket theme 40 and, if appropriate, the theme shape 60 also match the article theme 34 and cover theme 36. Alternatively, the user can purchase a pillow 12 having a cover theme 36 on the outer surface 38 of top panel 14 and/or bottom panel 16 and then place the appropriate articles 30, having article theme 34 that corresponds to cover theme 36, inside himself or herself. In addition to use as a general gift item, the pillow system 10 is suitable for use on special occasions, as exemplified by the love/relationship example of FIG. 7. Other special occasions can include, but are not limited to, weddings, travel, accomplishments, personal journals and the like. In addition to the above, the articles 30 can also include, but are not limited to, photographs, personal notes, diaries, tools, camping gear and a wide variety of other items. Although soft materials such as cloth, silk and the like are preferred for top 14 and bottom 16 panels, a wide variety of materials can be utilized in a wide range of shapes and sizes.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to various modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A pillow system, comprising:

a pillow having a top panel and an opposing bottom panel joined at the periphery thereof to define a periphery edge around said pillow, said pillow having a cushioning material disposed between said top panel and said bottom panel and enclosed by said periphery edge, said pillow having an outer surface substantially covering at least one of said top panel and said bottom panel, said outer surface having a cover theme thereon;

a pocket disposed in said pillow, said pocket accessible through a pocket inlet in said peripheral edge, said pocket extending into and substantially enclosed by said cushioning material;

closure means along said peripheral edge at said pocket inlet for at least substantially closing said pocket; and one or more articles disposed in said pocket and enclosed by said closure means, said articles having an article theme corresponding to said cover theme.

2. The pillow system according to claim 1, wherein each of said top panel and said bottom panel comprise said outer surface with said cover theme thereon.

3. The pillow system according to claim 1, wherein said closure means is a zipper.

4. The pillow system according to claim 1, wherein said pocket has an inner surface with a pocket theme corresponding to said cover theme and said article theme.

5. The pillow system according to claim 1, wherein said one or more articles are selected from the group comprising a book, an article of clothing, a stuffed animal, a toy, a doll, a DVD and a video game.

6. The pillow system according to claim 1, wherein said pillow is configured in a theme shape corresponding to said cover theme and said article theme.

7. The pillow system according to claim 6, wherein said theme shape is heart-shaped and said cover theme comprises love-related text and/or pictures and said article theme is one or more love-related items.

8. A pillow system, comprising:

a pillow having a top panel and an opposing bottom panel joined at the periphery thereof to define a periphery edge around said pillow, said pillow having a cushioning material disposed between said top panel and said bottom panel and enclosed by said periphery edge, said pillow having an outer surface substantially covering each of said top panel and said bottom panel, said outer surface having a cover theme thereon;

a pocket disposed in said pillow, said pocket accessible through a pocket inlet in said peripheral edge, said pocket extending into and substantially enclosed by said cushioning material, said pocket having an inner surface with a pocket theme corresponding to said cover theme;

closure means along said peripheral edge at said pocket inlet for at least substantially closing said pocket; and one or more articles disposed in said pocket and enclosed by said closure means, said articles having an article theme corresponding to said cover theme.

9. The pillow system according to claim 8, wherein said closure means is a zipper.

10. The pillow system according to claim 8, wherein said one or more articles are selected from the group comprising a book, an article of clothing, a stuffed animal, a toy, a doll, a DVD and a video game.

11. The pillow system according to claim 8, wherein said pillow is configured in a theme shape corresponding to said cover theme and said article theme.

12. The pillow system according to claim 11, wherein said theme shape is heart-shaped and said cover theme comprises love-related text and/or pictures and said article theme is one or more love-related items.

13. A pillow, comprising:

a top panel a bottom panel opposing said top panel, said top panel and said bottom panel joined at the periphery thereof to define a periphery edge around said pillow;

a cushioning material disposed between said top panel and said bottom panel and enclosed by said periphery edge;

an outer surface substantially covering at least one of said top panel and said bottom panel, said outer surface having a cover theme thereon;

a pocket disposed in between said top panel and said bottom panel, said pocket accessible through a pocket inlet in said peripheral edge, said pocket extending into and substantially enclosed by said cushioning material;

closure means along said peripheral edge at said pocket inlet for at least substantially closing said pocket; and one or more articles disposed in said pocket and enclosed by said closure means, said articles having an article theme corresponding to said cover theme.

14. The pillow according to claim 13, wherein each of said top panel and said bottom panel comprise said outer surface with said cover theme thereon.

15. The pillow according to claim 13, wherein said closure means is a zipper.

16. The pillow according to claim 13, wherein said pocket has an inner surface with a pocket theme corresponding to said cover theme and said article theme.

17. The pillow according to claim 13, wherein said one or more articles are selected from the group comprising a book, an article of clothing, a stuffed animal, a toy, a doll, a DVD and a video game.

18. The pillow according to claim 13, wherein said top panel and said bottom panel are configured in a theme shape corresponding to said cover theme and said article theme.

19. The pillow according to claim 18, wherein said theme shape is heart-shaped and said cover theme comprises love-related text and/or pictures and said article theme is one or more love-related items.

* * * * *